US007104691B2

(12) United States Patent
Chi

(10) Patent No.: US 7,104,691 B2
(45) Date of Patent: Sep. 12, 2006

(54) SELF-MOVING SLIDE, MECHANISM FOR SELF-MOVING SLIDE AND METHOD FOR SELF-MOVING A SLIDE

(75) Inventor: Quinn Chi, South El Monte, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 64 days.

(21) Appl. No.: 10/889,616

(22) Filed: Jul. 12, 2004

(65) Prior Publication Data

US 2005/0025400 A1 Feb. 3, 2005

Related U.S. Application Data

(60) Provisional application No. 60/491,349, filed on Jul. 31, 2003.

(51) Int. Cl.
*A47B 88/04* (2006.01)

(52) U.S. Cl. ..... 384/21; 312/319.1; 312/333

(58) Field of Classification Search ..... 312/333, 312/319.1, 330.1, 334.1, 334.7, 334.8, 334.11, 312/334.44; 384/20, 21
See application file for complete search history.

(56) References Cited

U.S. PATENT DOCUMENTS

| | | | |
|---|---|---|---|
| 930,534 | A | 8/1909 | Cox |
| 3,104,142 | A | 9/1963 | Knape et al. |
| 3,139,313 | A | 6/1964 | Rule |
| 3,243,247 | A | 3/1966 | Knape |
| 3,506,292 | A | 4/1970 | Hagendoorn et al. |
| 3,574,437 | A | 4/1971 | Stein et al. |
| 3,666,342 | A | 5/1972 | Biesecker |
| 3,697,140 | A | 10/1972 | Livingston |
| 3,700,301 | A | 10/1972 | Boeck |
| 3,713,681 | A | 1/1973 | Worley |
| 3,716,279 | A | 2/1973 | Anderson et al. |
| 3,954,315 | A | 5/1976 | Sanden |
| 3,973,814 | A | 8/1976 | Entrikin |
| 4,006,951 | A | 2/1977 | Geer et al. |
| 4,116,512 | A | 9/1978 | Wiser |
| 4,138,174 | A | 2/1979 | Cox et al. |
| 4,155,610 | A | 5/1979 | Englund |
| 4,159,153 | A | 6/1979 | Yoshikawa |
| 4,423,914 | A | 1/1984 | Vander Ley |
| 4,494,806 | A | 1/1985 | Williams et al. |

(Continued)

FOREIGN PATENT DOCUMENTS

DE 41 24512 A1 2/1992

(Continued)

OTHER PUBLICATIONS

FR 5000 Full-Extension Ballbearing Drawerslide, Fulterer, p. 39.

(Continued)

*Primary Examiner*—Thomas R. Hannon
(74) *Attorney, Agent, or Firm*—Christie, Parker & Hale, LLP

(57) ABSTRACT

A mechanism is provided that couples to a slide member of at least a two member slide forming a self-moving slide as well as to a self-moving slide incorporating such a mechanism. The mechanism has a housing having a first slot guiding an actuator and a second slot spaced apart from the first slot. The actuator is spring coupled to the housing. The actuator engages a second slide member of the slide. The spring generates a force for moving the actuator and the engaged second slide member along the first slot. The second slot allows for a portion of the housing between the two slots to flex.

31 Claims, 13 Drawing Sheets

U.S. PATENT DOCUMENTS

| | | | |
|---|---|---|---|
| 4,501,455 | A | 2/1985 | Groseck |
| 4,600,255 | A | 7/1986 | Dubarko |
| 4,615,095 | A | 10/1986 | Bessinger et al. |
| 4,653,820 | A | 3/1987 | Tazaki |
| 4,679,950 | A | 7/1987 | Delmege et al. |
| 4,811,579 | A | 3/1989 | Lyons et al. |
| 4,872,734 | A | 10/1989 | Rechberg |
| 5,015,048 | A | 5/1991 | Brunnert |
| 5,020,868 | A | 6/1991 | Brunnert |
| 5,033,805 | A | 7/1991 | Hobbs |
| 5,040,833 | A | 8/1991 | Brunnert |
| 5,040,858 | A | 8/1991 | Kruse et al. |
| 5,056,879 | A | 10/1991 | Röck et al. |
| 5,207,781 | A | 5/1993 | Röck |
| 5,226,716 | A | 7/1993 | Geil |
| 5,232,278 | A | 8/1993 | O'Brien et al. |
| 5,240,318 | A | 8/1993 | Schröder et al. |
| 5,255,983 | A | 10/1993 | Parvin |
| 5,302,016 | A | 4/1994 | Lautenschläger et al. |
| 5,312,180 | A | 5/1994 | Tieder et al. |
| 5,364,179 | A | 11/1994 | Brüstle et al. |
| 5,388,902 | A | 2/1995 | Huebschen et al. |
| 5,421,481 | A | 6/1995 | Fortmann et al. |
| 5,433,517 | A | 7/1995 | Fleisch |
| 5,474,375 | A | 12/1995 | Hollenstein et al. |
| 5,484,209 | A | 1/1996 | Weng |
| 5,520,452 | A | 5/1996 | Petersen et al. |
| 5,542,759 | A | 8/1996 | Krivec |
| 5,580,138 | A | 12/1996 | Grabher |
| 5,671,988 | A | 9/1997 | O'Neill |
| 5,671,989 | A | 9/1997 | Lautenschläger |
| 5,681,066 | A | 10/1997 | Anderson |
| 5,730,514 | A | 3/1998 | Hashemi |
| 5,733,027 | A | 3/1998 | Lautenschläger |
| 5,909,935 | A | 6/1999 | Esperandieu et al. |
| 5,944,396 | A | 8/1999 | Stephan |
| 5,961,193 | A | 10/1999 | Hobbs |
| 5,975,662 | A | 11/1999 | Weber |
| 6,254,205 | B1 | 7/2001 | Wright et al. |
| 6,340,078 | B1 | 1/2002 | Scheible |
| 6,412,891 | B1 | 7/2002 | Liang et al. |
| 6,666,306 | B1 | 12/2003 | Gasser |
| 6,712,435 | B1 * | 3/2004 | Kim et al. ..... 312/319.1 |
| 6,733,097 | B1 * | 5/2004 | Kim et al. ..... 312/333 |
| 6,752,478 | B1 | 6/2004 | Francz |
| 6,953,233 | B1 | 10/2005 | Lam et al. |
| 6,971,729 | B1 * | 12/2005 | Kim et al. ..... 312/319.1 |
| 2002/0011766 | A1 | 1/2002 | Kim et al. |
| 2002/0033658 | A1 | 3/2002 | Salice |
| 2003/0067257 | A1 | 4/2003 | Gasser |
| 2003/0075845 | A1 | 4/2003 | Krammer |
| 2004/0000850 | A1 | 1/2004 | Lam et al. |
| 2004/0107536 | A1 | 6/2004 | Hollenstein |

FOREIGN PATENT DOCUMENTS

| | | |
|---|---|---|
| DE | 91 14 787.5 U1 | 2/1992 |
| DE | 297 01 895.7 | 3/1997 |
| EP | 0 386 731 B1 | 9/1990 |
| EP | 0 391 221 A1 | 10/1990 |
| EP | 0 529 679 B1 | 3/1993 |
| EP | 0 552 500 A1 | 7/1993 |
| JP | 405317133 A | 12/1993 |

OTHER PUBLICATIONS

Selby On-Line Furniture Brochure, "Drawer Slides", Selby Furniture Hardware Co., Inc.—The Houdini of Hardware, May 2, 2003, 3 pages.

* cited by examiner

SELF-MOVING SLIDE, MECHANISM FOR SELF-MOVING SLIDE AND METHOD FOR SELF-MOVING A SLIDE

CROSS-REFERENCE TO RELATED APPLICATION

This application is based upon and claims priority of U.S. Provisional Application No. 60/491,349, filed on Jul. 31, 2003, the contents of which are fully incorporated herein by reference.

BACKGROUND OF THE INVENTION

The present invention is directed to a self-moving slide, a mechanism for a self-moving slide, and a method for self-moving a slide.

Drawers are typically coupled to cabinets using slides. These slides are typically two-member slides or three-member slides. A two-member slide comprises an outer member and an inner member. The inner member is slidably coupled to the outer member and can telescope relative to the outer member. A three-member slide comprises three members, namely, an outer member, an intermediate member, and an inner member. The intermediate member is slidably coupled to the outer member and the inner member is slidably coupled to the intermediate member. Both the intermediate and inner member telescope relative to the outer member. Moreover, the inner member can telescope relative to the intermediate member. Typically the slide outer members are coupled to the cabinet and their inner members are coupled to either side of the drawer. The problem with many drawers is that they tend to open after they are closed. Another problem with drawers is that when they are pushed to close, they sometimes do not close completely because they are not pushed with sufficient force or alternatively they are pushed with more force than necessary causing the drawers to slam against the cabinet and then re-open.

To overcome these problems some slides incorporate self-closing mechanisms that use an extension spring coupled to the outer member of the slide. The spring engages a tab or pin welded or otherwise fixed to the inner member of the slide to pull the inner member toward the outer member and close the slide. The problem with these mechanisms is that the spring is in an extended or stretched position until it is engaged by the tab or pin fixed to the inner member. As such, the spring remains stretched until the slide closes. Consequently, if the spring breaks while stretched—which a common failure mode for extension springs—it will have a tendency to eject from the mechanism creating a hazardous condition. Moreover, the tabs tend to break off from the inner member with usage due to fatigue causing early failure of the self-closing mechanism.

Consequently, a mechanism is desired for use in slides that will keep the slides in a closed position when the slides are fully closed, that will also help the slide self-close as they reach close to the end of their rearward travel and which are not subject to the early failures and hazardous conditions created by currently available slide self-closing mechanisms.

SUMMARY OF THE INVENTION

A self-moving mechanism, a self-moving slide incorporating a self-moving mechanism and a method of self moving a slide are provided. In one exemplary embodiment a self-moving slide is provided incorporating an exemplary embodiment self-moving mechanism. The exemplary embodiment self-moving slide has a first slide member, and a second slide member slidably coupled to the.first slide member. The exemplary embodiment self-moving mechanism is coupled to the second slide member. The exemplary embodiment self-moving mechanism has a housing, a first slot formed on a wall of the housing, the first slot having a first longitudinal portion and a second portion extending transverse to the first longitudinal portion. A junction is defined on the housing wall between the first and second slot portions. A second slot is formed on the wall of the housing. An actuator is moveable along the first slot between the first longitudinal portion and the second portion, wherein as the actuator moves between the first longitudinal portion and the second longitudinal portion it exerts a force against the junction, and wherein the second slot allows a portion of said wall including the junction to move in response to the force.

In another exemplary embodiment self-moving mechanism, a spring coupled to the actuator, wherein the actuator moves in response to a force generated by said spring. In yet a further exemplary embodiment self-moving mechanism, the second slot has a first longitudinal portion, a second longitudinal portion, and an intermediate portion between the first and second longitudinal portions, wherein the intermediate portion is transverse to both the first and second portions.

DETAILED DESCRIPTION OF THE INVENTION

Self-moving mechanisms such as self-opening or self-closing mechanisms are provided that attach to slide members of slides, for self-opening or self-closing a slide member of such slides, respectively, i.e., for self-moving a slide member of such slides. For illustrative purposes the inventive mechanism is used and described herein as a self-closing mechanism in that it is used to self-close a slide. However, it should be understood that the same mechanism can be used to self-open a slide.

Exemplary embodiment self-closing mechanisms are mounted at or proximate the rearmost ends of slide members. Consequently, slides incorporating such mechanisms become self-closing slides. For convenience, the mechanisms are described herein in relation to a three-member slide. However, the mechanisms can be incorporated into two member slides or other slides using multiple sliding members.

Figure 1:
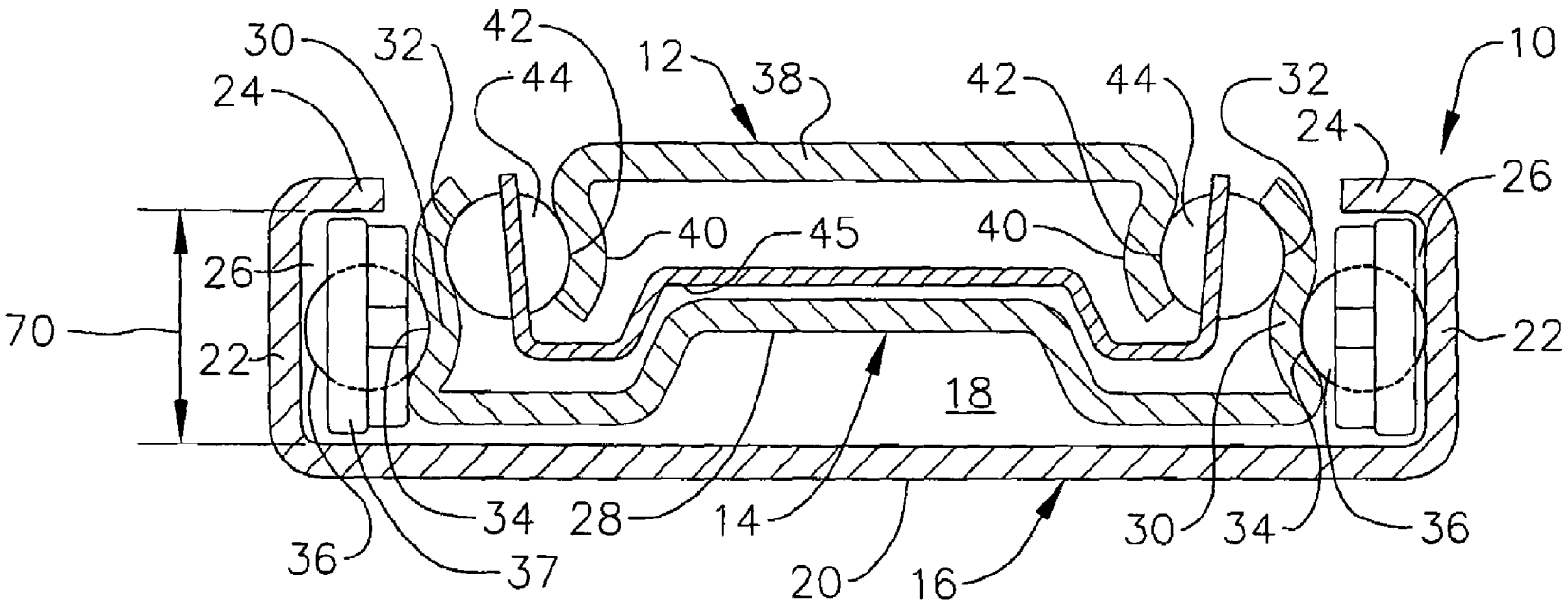
FIG. 1 is a cross-sectional view of a three-member slide.

A typical exemplary three member slide 10 comprises an inner member 12 slidably coupled to an intermediate member 14 which is slidably coupled to an outer member 16 (FIG. 1). The outer member is channel shaped in cross section, i.e., it defines a channel 18, having web 20 and two legs 22 extending preferably perpendicularly from opposite ends of the web. A lip 24 extends preferably perpendicularly from each leg such that the two lips extend toward each other. A bearing raceway 26 is defined by each lip, its corresponding leg and the web. The intermediate slide member 14, also generally channel shaped in cross-section, is slidably coupled within the outer member 16.

In cross-section, the intermediate member also comprises a web 28 and two legs 30 extending from opposite ends of the web. Each of the legs has a double curvature such that each leg defines an inner raceway 32 and an outer raceway 34. The intermediate member is slidably coupled within the outer member with their "channels" facing in the same direction. Ball bearings 36 are sandwiched between the inner bearing raceways 26 of the outer member and the outer bearing raceways 34 of the intermediate member. The ball bearing are typically coupled to an outer ball bearing retainer 37.

The inner member is also channel shaped in cross-section comprising a web 38 having two legs 40 extending from opposite ends of the web. A concavity is formed on the outer surface of each leg defining an outer bearing raceway 42. The inner member is slidably coupled to the intermediate member with the channel of the inner member facing opposite the channel of the intermediate member. In other words, the legs of the inner member extend from the web 38 of the inner member toward the web 28 of the intermediate member. Ball bearings 44 are sandwiched between the outer bearing raceways 42 of the inner member and the inner bearing raceways 32 of the intermediate member. The ball bearing are typically coupled to an inner ball bearing retainer 45. Each slide member is typically formed from a single piece of material.

Figure 2A:
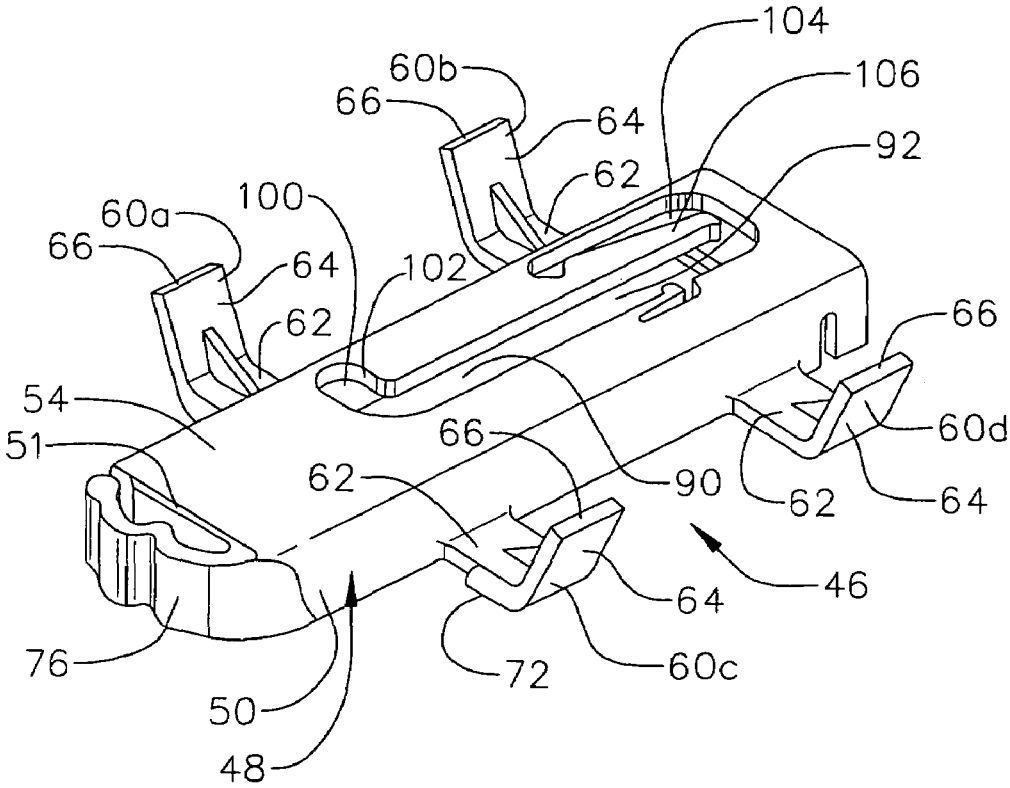
FIGS. 2A and 2B are a perspective and side view, respectively, of the housing of an exemplary embodiment self-moving mechanism of the present invention.
Figure 3:
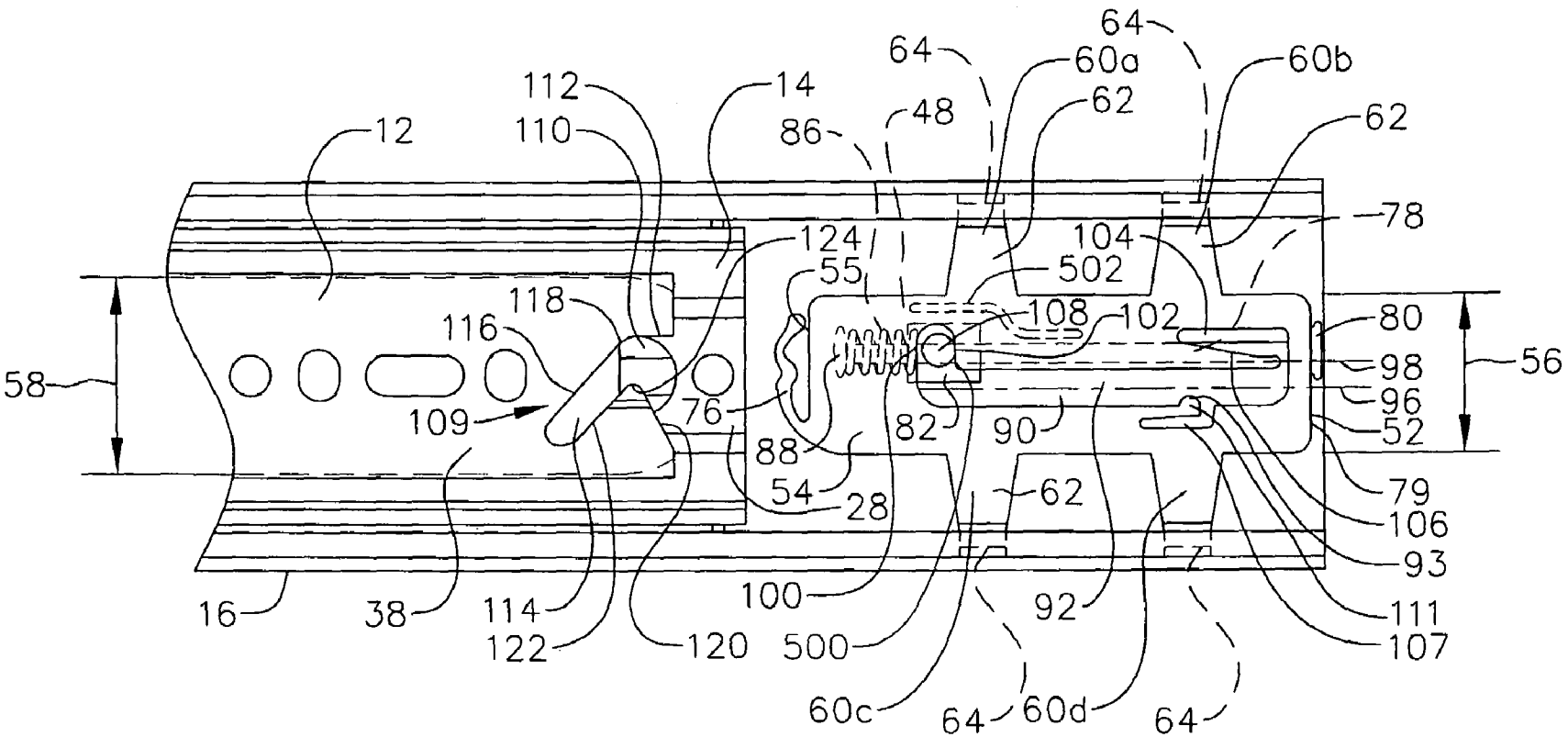
FIG. 3 is a partial top view of an exemplary embodiment three-member self-closing slide incorporating an exemplary embodiment self-moving mechanism of the present invention.

An exemplary embodiment self-closing mechanism 46 of an embodiment of the present invention comprises an elongated housing or body 48 having opposing side walls 50, an rear wall 52 and top wall 54 (FIGS. 2A and 3). The housing may also have a front wall 55. The width 56 of the top wall, i.e., the spacing between the side walls, is smaller than the width 58 of the slide inner member web 38. In this regard, the inner member can slide over the housing. The housing may also have a base or bottom wall (not shown). The terms, "upper, " "lower," "top," "bottom," "base," "upward," "downward," "forward," "rear," "front" and "back" are used as relative terms and are not meant to denote the exact location of a member operated by such term.

Figure 2B:
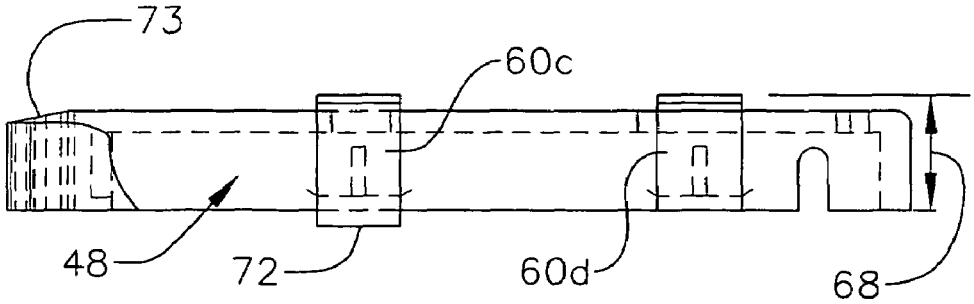

Two, but preferably four legs 60*a*, 60*b*, 60*c*, 60*d* extend transversely from the base portion of the exemplary embodiment housing sides 50 In an exemplary embodiment two legs extend from either side of the housing from proximate the base of the sides. Each leg comprises a first portion 62 extending laterally from a side wall 50 of the housing. Each of the legs also comprise a second portion 64 extending from the first portion inclined at an angle relative to the first portion such that the free-end 66 of the second portion is higher than the first portion. The second portions have a height 68 as measured perpendicularly to the first portion that is preferably slightly smaller than an inner height 70 of the inner bearing raceway of the outer member (FIGS. 1 and 2B). The housing and legs are preferably integrally formed and are preferably made of plastic. In this regard, the legs are flexible allowing for the housing to be "snapped-in" place on the slide outer member.

Figure 4:
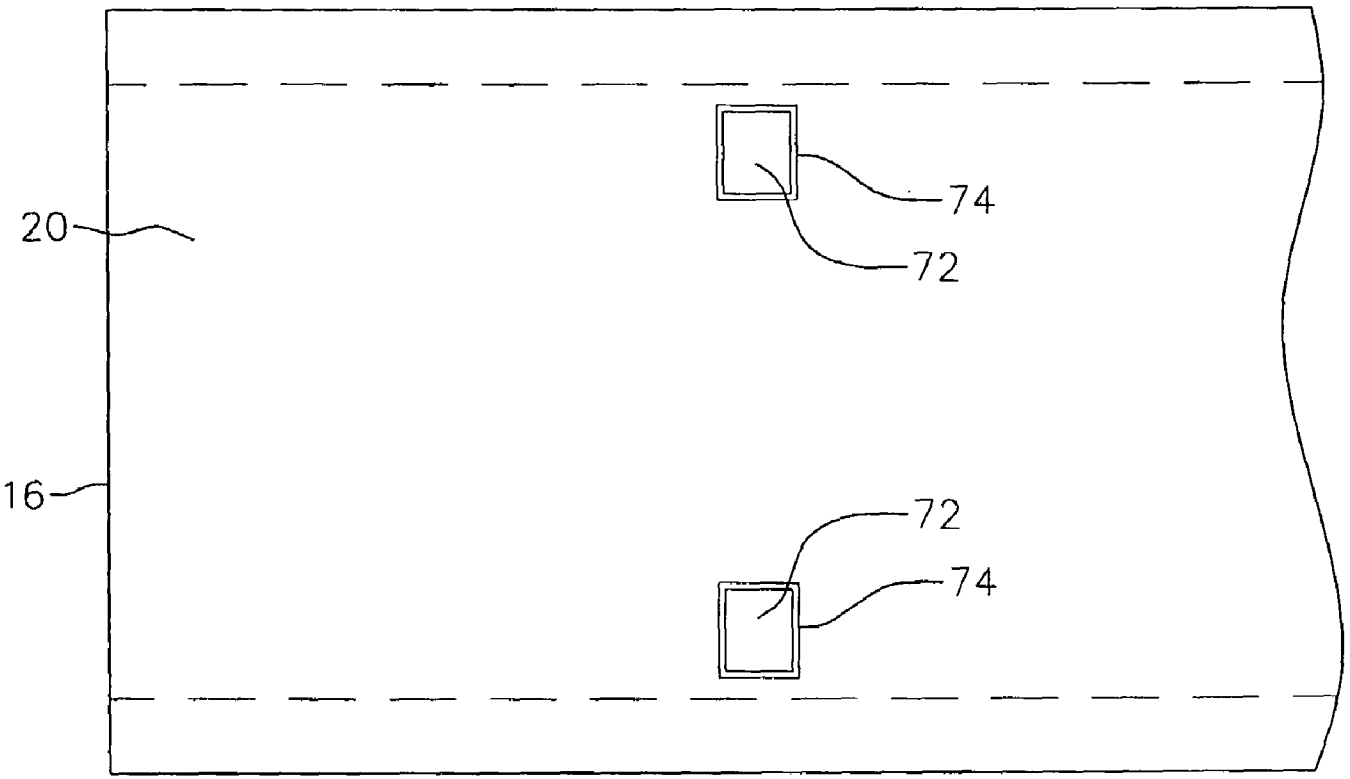
FIG. 4 is a partial bottom view of the self-closing slide shown in FIG. 3.

The housing with legs is mounted within the outer slide channel at the rearmost end portion as shown in FIG. 3. Specifically, the housing with legs is slid or "snapped-in" within the channel defined by the outer slide such that the free ends 66 of the leg second portions engage the inner surfaces of lip portions 24 of the outer slide. Consequently, the leg second portions which occupy the height 70 of almost the entire inner bearing raceway fit tightly within the inner bearing raceways 26 of the outer member. In an exemplary embodiment, a protrusion 72 is formed extending from the bottom surface of the first portion of at least one leg but preferably extending from the bottom surfaces of at least two oppositely extending legs, as for example legs 60*a* and 60*c* (FIGS. 2A and 2B). Complementary slots 74 are formed through the web 20 of the outer slide member 16 such that when the legs are urged toward the web 20, the protrusions 72 enter their complementary slots 74 thereby providing a more secure engagement between the housing and the slide outer member (FIG. 4).

When the housing is attached to the outer slide member, it is in the sliding path of the slide intermediate member 14, as for example shown in FIG. 3. To accommodate for the length of the outer member occupied by the housing, the intermediate member preferably has a length shorter than outer member 16 so that when it is in the fully retracted position relative to the outer member, the intermediate member does not extend beyond the outer member.

When the mechanism is incorporated in a three-member slide, a stop member may extend from the front portion of the housing for stopping the travel of the intermediate member and silence an impact of the intermediate member on the housing. The stop member may be resilient material mounted on the front portion of the housing. In an exemplary embodiment, the stop member is a flexing arm 76 integrally formed with the housing 48 and extending from one side of the housing transversely to proximate the other side of the housing. When the web 28 of the intermediate member strikes the flexing arm 76, the arm flexes toward the housing to soften and silence the impact while providing a stop to the rearward travel of the intermediate member. Preferably the stop member is shorter in height than the housing and the upper surface 73 of the front portion of the housing is tapered so as to increase in height in a direction toward the rear of the housing as for example shown in FIG. 2B. In this regard, if the inner slide member were to contact the tapered upper surface 73 as it slides toward a closed position, it would ramp up and over the housing.

A guide rod also referred to herein for convenience as a "guide pin" or "pin" 78 is coupled to the rear wall 52 of the housing and extends within the housing as shown in FIG. 3. The guide pin in the exemplary embodiment shown in FIG. 3 and described herein is cylindrical, i.e., it has a circular cross-sectional shape. However, the pin may have other cross-sectional shapes.

The pin is coupled to the rear wall of the housing slightly nearer one of the side walls 50 and is capable of pivoting relative to the rear wall. Pivoting can be accomplished by providing an opening through the rear wall 52 having a diameter much larger than the guide pin 78 diameter. An end of the pin protrudes through the rear wall opening and is capped forming a rear cap 80 having a larger diameter than the opening. In this regard, the capped end is prevented from re-entering the housing and the pin is able to move sideways within the opening and thereby allowing the guide pin to pivot relative to the rear wall. In an alternate embodiment, the guide pin is allowed to exit the housing through a rear wall opening and is then bent such that the bent portion of the pin engages the outer surface 79 of the rear wall 52 preventing the pin from retracting back into the housing.

Figure 5A:
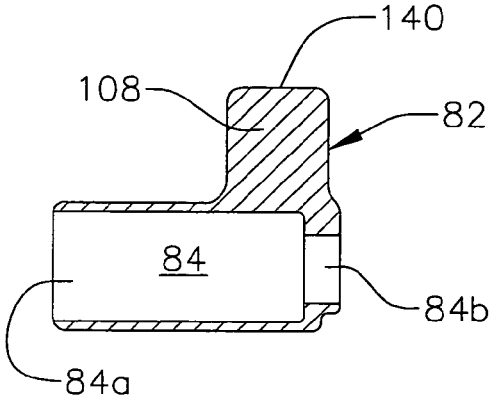
FIGS. 5A and 5B are a cross-sectional and a perspective view, respectively, of an actuator used in the self-moving mechanism shown in FIG. 2A.
Figure 5B:
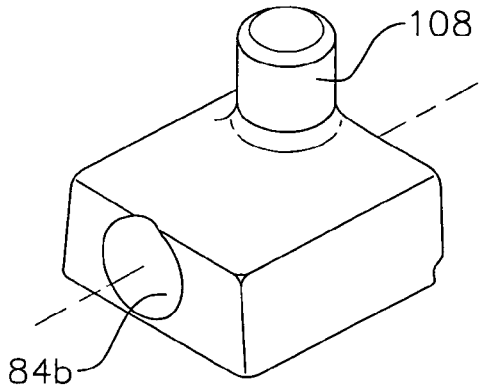

An actuator 82 is slidably coupled to the guide pin 78 such that it can slide along the guide pin length (FIGS. 3 and 5A). Typically, the actuator comprises an opening 84 that is penetrated by the pin, thus, allowing the actuator to slide along the pin. Preferably the opening 84 is a sectioned opening having a first larger diameter section 84*a* and a second smaller diameter section 84*b*. A spring 86 is placed over the pin for urging the actuator toward the rear wall 52 of the housing. The spring has an outer surface diameter larger than the diameter of the actuator opening smaller diameter section 84*b* and smaller than the diameter of the actuator opening larger diameter section 84*a*. The pin is capped at its front end forming a front cap 88 or is bent so as to retain the spring over the guide pin. The guide pin 78, spring 86 and actuator 82 are all housed within the housing 46 and can all pivot with the pin relative to the rear wall of the housing.

A slot 90 is formed through the top wall of the housing. The slot has a major longitudinal portion 92 having a central longitudinal axis 96 which is preferably offset in parallel from a central longitudinal axis 98 of the housing. The slot longitudinal portion extends from preferably proximate the rear wall of the housing toward the front wall 55. A transverse portion 100 of the slot extends transversely from the forward end of the slot longitudinal portion in a direction crossing the central longitudinal axis 98 of the housing. The rear most edge of the transverse portion of the slot defines a transverse edge 102.

A longitudinal slit 104 is formed on the top wall proximate the rear wall and offset form the slot longitudinal portion 92. The slit is shorter than the slot and it is in communication with the slot at its rearmost end. Consequently, a flexible tine 106 is defined between the slot and the slit.

In an exemplary embodiment, a second slit 107 is formed on the edge of the slot longitudinal portion 92 opposite the tine 106 and proximate the rear end of the slot longitudinal portion. The second slit defines a flexible detent 111 which extends into the path of the slot longitudinal portion 92. The detent may have a protrusion 93 extending into the slot longitudinal portion.

A guide member 108 extends from an upper surface of the actuator and is fitted within the slot 90 (FIGS. 3 and 5A). In one exemplary embodiment, shown in FIGS. 3 and 5A, the guide member is in the form of a pin 140. The guide member and actuator are preferably integrally formed. The slot 90 serves to guide the guide member and thereby the actuator travel along the housing. As the actuator travels along the housing, the guide pin 78 pivots relative to the housing rear wall 52 to accommodate the actuator travel. When in the rear end of the slot, the pin and thus the actuator can move laterally against the tine 106, flexing the tine.

As the actuator is moved forward along the slot 90, it compresses the spring 86 against the guide pin front cap 88. When at the front end of the slot, the actuator guide follows the curved portion of the slot and into the transverse portion 100 of the slot as the guide pin 78 is pivoted about the rear wall. When at that position, the spring is compressed providing a force attempting to urge the actuator in a direction toward the rear wall. The force causes the actuator guide member to engage the transverse edge 102 defined by the transverse slot portion on the housing top wall and thereby maintain the actuator within the transverse slot portion in an "armed" state. The transverse edge 102 is of sufficient length to support the actuator guide member 108. When the guide member is moved transversely toward the longitudinal portion of the slot, the spring force causes the actuator to move along the slot to rear end of the slot.

Figure 6A:
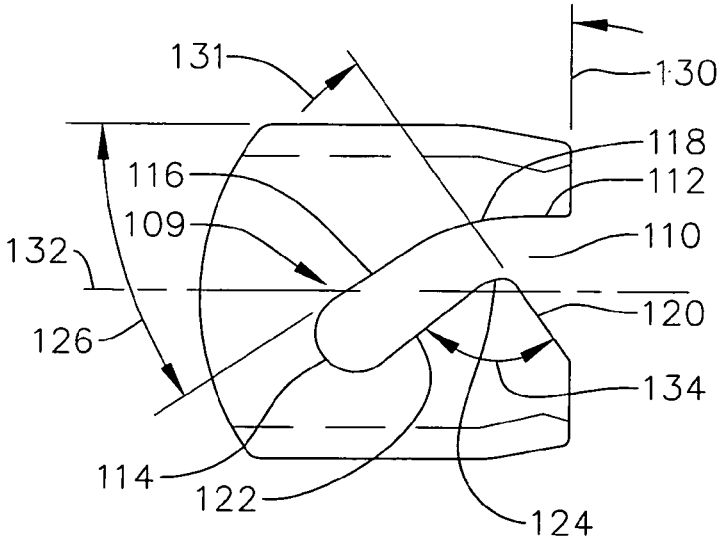
FIGS. 6A and 6B are an enlarged section top view and an end view, respectively, of the inner slide member of the self-closing slide shown in FIG. 3.

A web slot 109 is formed on the rear end of the web 38 of the inner slide member 12. The slot has a short first portion 110 longitudinally extending from the rear end of the inner member web 38 (FIGS. 3 and 6A). The first portion of the web slot is aligned to straddle the guide member of the actuator as the inner member is slid over the housing. The web slot first portion has a first longitudinal edge 112 positioned furthest from the longitudinal slot on the housing top wall. The web slot than curves in a direction toward the longitudinal slot of the top wall and forms a second inclined slot portion 114. The second slot portion has a first edge 116 inclined relative to the first edge 112 of the slot first longitudinal portion at an angle which in an exemplary embodiment is less than 90°. A curved edge 118 forms the transition between the first edges of the first and second slot portions.

The second edge 120 of the first slot portion 110 opposite the first longitudinal edge 112 extends away from the first longitudinal edge to the rear end of the inner member web. The second edge 120 of the first web slot portion extends transversely to at least a location axially aligned with the longitudinal portion 92 of the slot formed on the housing top wall. Preferably, the second edge 120 spans a distance sufficient for engaging the actuator guide member when the actuator guide member is located within the longitudinal portion 92 of the slot formed on the housing top wall. More preferably, the second edge 120 spans transversely to a distance covering the entire width of the longitudinal portion 92 of the housing top wall slot.

A second edge 122 of the web second slot portion 114 opposite the inclined first edge 116 is inclined at an angle to the second edge 120 of the first slot portion and extends in a direction similar to the first edge 116 of the second web slot portion. The point of intersection between second edge of the first slot portion and the second edge of the second slot portion is preferably rounded forming a tip 124.

As the inner member of the slide is retracted rearward toward a closed position, the guide member of the actuator enters the first portion 110 of the web slot 109. As the inner member continues to move rearward, the actuator guide member 108 makes contact with the curved edge 118 of the web slot and then the first edge 116 of the second slot portion. When that occurs and as the inner member further retracts, the actuator guide member is guided transversely by the first edge 116 of the web slot second portion along the web slot second portion 114. This causes the actuator guide member and thus the actuator to move transversely along the transverse portion 100 of the slot on the housing top wall and to the longitudinal portion 92 of the top wall slot. When that occurs, the spring "unarms" and the spring force causes the actuator to travel rearwards along the guide pin and the actuator guide member to travel rearward along the longitudinal portion 92 of the slot formed on the housing top wall. As the actuator guide member is moved rearwardly by the spring force, it engages and applies a force on the second edge 122 of the second slot portion 114 of the web slot causing the inner member to slide rearwardly with the guide member and the slide to self close.

As the slide inner member is extended after being closed, the second edge 122 of the web slot second portion 114 applies a force on the actuator guide member causing the guide member to move forward along the longitudinal portion 92 of the slot on the housing top wall and against the spring force compressing the spring 86. When the actuator guide member reaches the front end of the longitudinal portion 92 of the top wall slot its longitudinal motion is stopped as the inner slide member continues to extend. Consequently, the actuator guide member begins to move rearwardly relative to the web slot 109 and along the second edge 122 of the second portion of the web slot 109. Thus, the actuator guide member is moved transversely relative to the housing and along the transverse portion 100 of the top wall slot where it engages the transverse edge 102 on the housing top wall as a result of the applied spring force. As the inner member is further extended the guide member exits the web slot 109 and remains "armed" against the transverse edge 102.

When the actuator is in the rearmost position, e.g. when the slide is in a closed position, the spring 86, which is in the exemplary embodiment is a compression spring, is in its normal extended position offering minimal or no force. In the exemplary embodiment shown in FIG. 3, the detent 111 controls any bouncing of the slide and actuator that may occur. If the slide with actuator attempt to re-extend, i.e., "bounce", from the closed position, the detent 111 which extends into the path of the slot longitudinal portion 92 formed on the housing top wall will engage the actuator guide member and stop the re-extending travel i.e., the bounce.

If the actuator guide member inadvertently disengages from the transverse edge 102 of the slot formed on the housing top wall and moves to the rear end of the housing by the spring force, the self-closing mechanism can be re-engaged by the inner slide member. This is accomplished by retracting the inner slide member. As the inner slide member is retracted, the second edge 120 of the inner member web slot first portion engages the actuator guide member 108. As the inner member is further retracted, the actuator guide member is caused to move transversely along the second edge 120 causing the guide member to engage and flex the tine 106 on the housing and move it transversely. When flexed, the tine provides a force against the actuator guide member 108 tending to push the guide member toward the longitudinal slot portion. As the inner slide member continues to retract, the actuator guide member reaches and passes the tip 124 of the web slot at which point the force generated by the tine causes the actuator guide member to move into the second slot portion 114 of the web slot 109. Once within the second slot portion 114, the actuator guide member is engaged by the inner slide member and extension of the slide member will cause the actuator guide member and the actuator to move into an "armed" position as discussed above.

Applicants have discovered that an incline angle 126 (FIG. 6A) of 34° between the first edge 116 of the web slot second portion and the first longitudinal edge 112 of the first longitudinal portion of the web slot to be optimum for the operation of the mechanism when the guide member 108 is cylindrical. A shallower angle may provide for smoother operation of the mechanism, but with such angle a longer second slot portion is required for moving the actuator guide member a sufficient transverse distance for disengaging from the transverse edge 102 of the transverse portion 100 of the slot formed on the housing top wall.

Applicants have also discovered that for optimum operation, the second edge 120 of the first web slot portion 110 should extend at angle 131 preferably of about 35° from an axis 130 perpendicular to the inner member web longitudinal axis 132 located at the rear end of the web. In addition, applicants have discovered that the second edge 122 of the second web slot portion should be inclined at an angle 134 of about 95° to the second edge 120 of the first slot portion. Furthermore, applicants have discovered that the tip 124 between second edge of the first slot portion and the second edge of the second slot portion should be rounded to allow for smooth re-engagement of the actuator guide member if it inadvertently disengages from the slide inner member. An exemplary radius for the tip is about 0.08 inch. Moreover, applicants have discovered that a spring 86 with a spring rate 1.2 lbs. per inch or capable of providing a force of 3 lbs. provides sufficient force for self-closing of a slide coupled to a typical kitchen drawer and cabinet.

Figure 6B:
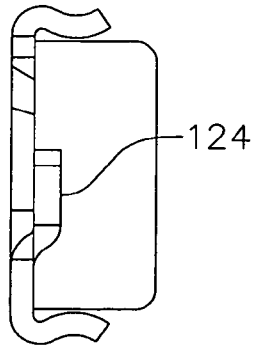

In an exemplary embodiment, the tip 124 formed on the web slot is joggled so as to engage the actuator guide member 108 along a lower location closer to the upper surface of the housing top wall as shown for example in FIG. 6B. In this regard, the force applied by the tip 124 to the actuator guide member is reacted more in shear, and less in moment, tending to move the actuator guide member and actuator. By applying a smaller moment to the actuator guide member, more of the force applied to the actuator guide member is used to move the actuator. Consequently, a lesser force is needed to move the actuator and the motion of the actuator is smoother.

In the exemplary embodiment shown in FIG. 3, the housing has a length of about 2.465 inches; the longitudinal slot extends to a length of about 1.6 inches along the housing top wall; the inner slide member web has a width of about 0.76 inch at the rear end of the inner member; the second slot portion extends a distance of about 0.694 inch into the inner slide member web as measured from the rear end of the web; the first edge of the first inner slide member web slot portion is located at about 0.698 inch from the outer surface of the furthest leg of the inner slide member; and the rounded tip is located at about 0.519 inch from the outer surface of the furthest leg of the inner slide member.

Figure 7A:
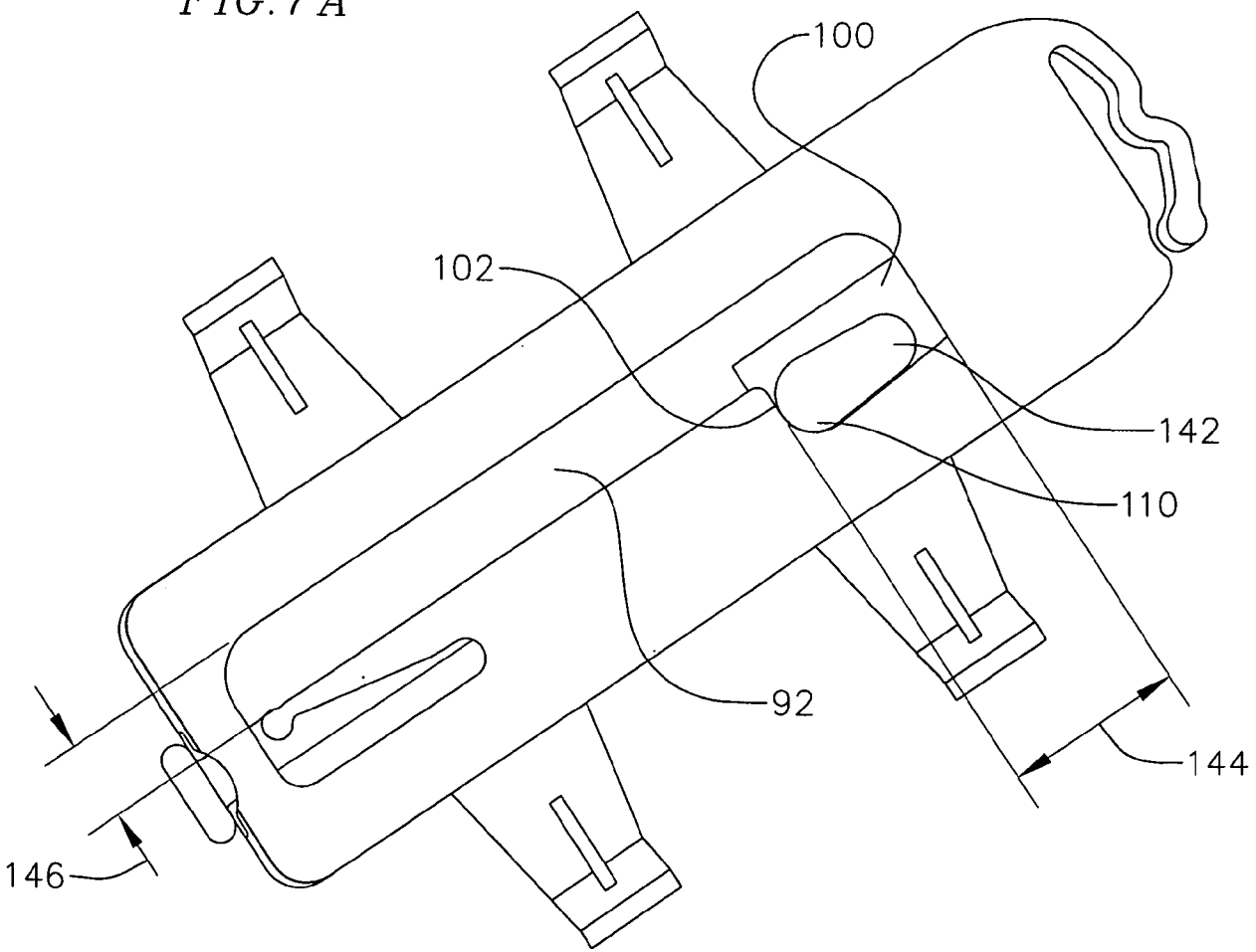
FIG. 7A is a top view of a self-moving mechanism incorporating a different exemplary embodiment actuator.
Figure 7B:
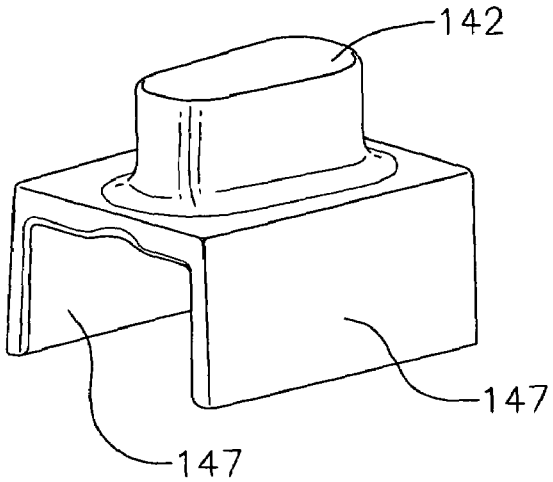
FIGS. 7B and 7C are a front and rear perspective views, respectively, of the actuator embodiment shown in FIG. 7A.
Figure 7C:
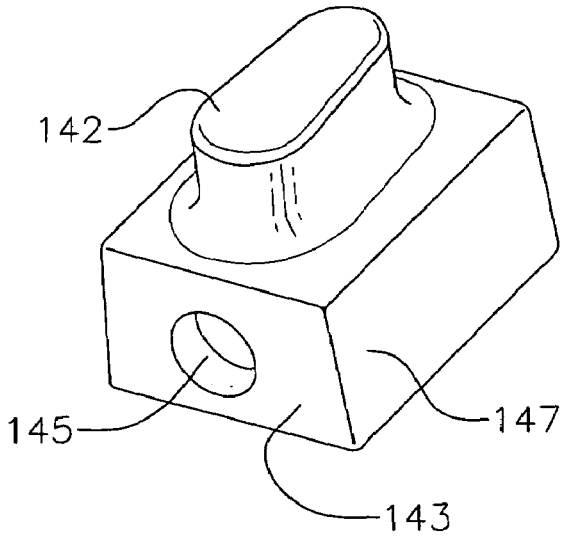

In another exemplary embodiment, the actuator guide member is an elongated protrusion 142 (FIGS. 7A, 7B and 7C). With this embodiment, the width 144 of the transverse portion 110 of the slot formed on the top wall of the housing should be wider than the width 146 of the longitudinal portion 92 of the slot to accommodate the increased length in the guide member. The longitudinal portion of the slot only has to accommodate the narrower width of the guide member. The increased length of the guide member protrusion provides more surface for engagement by the web slot of the inner member thereby reducing the force required to disengage the actuator guide member from the transverse edge 102 of the transverse slot 100 formed on the housing top wall. The increased length of the guide member also causes a reduction in the noise as the guide member moves across the web slot. This is due to the fact that the guide member, because of its increased length, will travel a smaller distance from one edge of the web slot before striking an opposite edge of the web slot.

A front and rear perspective view of the guide member incorporated in the exemplary embodiment mechanism shown in FIG. 7A is shown in FIGS. 7B and 7C, respectively. This exemplary embodiment actuator comprises a rear wall 143 having an opening 145 for penetration by the guide pin 78. The opening 145 has a diameter greater than the diameter of the guide pin 78 but smaller than the diameter of the spring 86. The actuator also comprises two side walls 147 and no front wall. By coupling the guide pin to the actuator only via the rear wall, the actuator is allowed to pivot laterally relative to the guide pin such that central longitudinal axis of the opening 145 is offset relative to the central longitudinal axis of the guide pin. This allows the actuator to have more freedom of movement relative to the guide pin making the movement of the actuator and thus of the mechanism easier. In an alternate embodiment, not shown, the actuator may have a front wall with an opening for the guide pin and no rear wall.

Figure 7D:
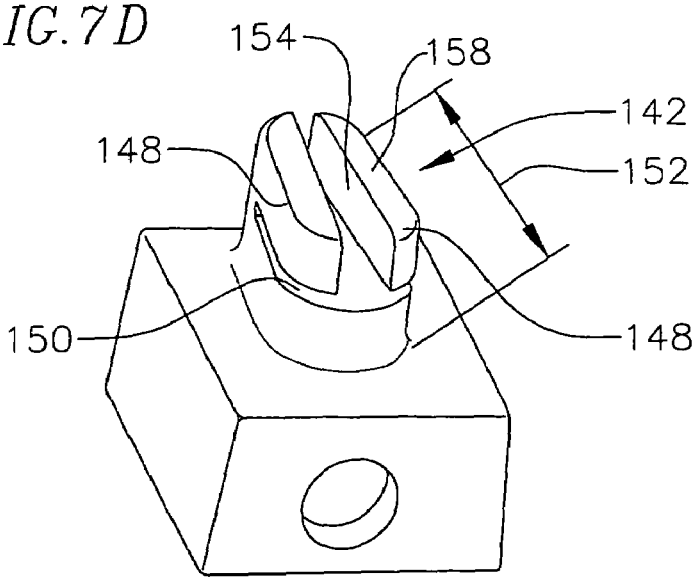
FIG. 7D is a perspective view of an alternate exemplary embodiment actuator.

In a further exemplary embodiment mechanism, an alternate embodiment actuator as shown in FIG. 7D is used. This embodiment guide member comprises an elongated protrusion 144 is made more flexible by having two flexible longitudinally extending members 148. These members may be formed by forming a slot 150 along a plane parallel to the upper surface of the protrusion that spans a portion of the length 152 of the protrusion and then forming a second slot 154 perpendicular to the first slot 150 extending to the upper surface 158 of the protrusion. The members which can flex reduce the impact noise when the actuator guide member is engaged by the web slot 109 of the slide inner member. In another exemplary embodiment, impact noise may be reduced by covering the actuator guide member, or at least the guide member protrusion, with a softer material, e.g., a rubbery material, cap.

Figure 8:
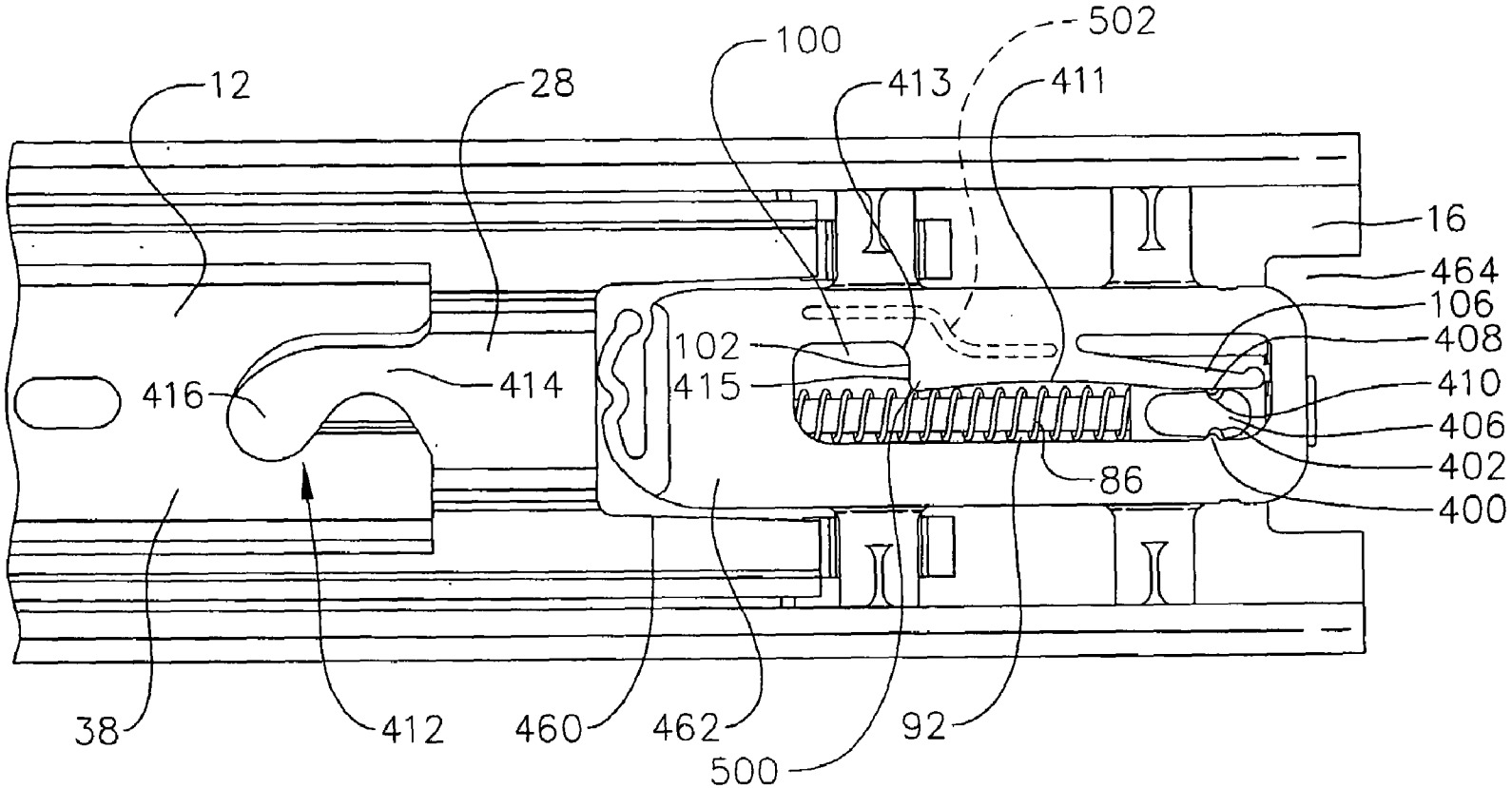
FIG. 8 is a partial top view of another exemplary embodiment three-member self-closing slide incorporating another exemplary embodiment self-moving mechanism of the present invention shown with its actuator in an unarmed state.

When an elongated protrusion forms the guide member, as for example the guide member 406 shown in FIG. 8 (or the guide member 142 shown in FIGS. 7C and 7D), a web slot 412 is formed on the web of the inner slide member having a first portion 414 extending from the rear end of the inner member web 38, and a second generally wider inclined slot portion 416 extending from the first portion. The second inclined portion is wider than the first portion to accommodate the elongated guide member.

In an alternate exemplary embodiment, as for example shown in FIG. 8, a bump or protrusion 400 is used in lieu of the detent 111. The bump 400 is formed on the edge of the longitudinal portion 92 of the slot 90 at a location opposite the tine 106 and extends within the slot portion 92. A complementary depression 402 is formed on the actuator guide member 406. When moving toward a closed position, i.e., rearward, the actuator guide member 406 is pushed sideways by the bump and in turns bends the tine 106. If the slide member with actuator guide member attempt to "bounce," i.e., to re-extend after closing, the bump 400 would engage the complementary depression 402 and suppress or stop the bounce, i.e., prevent slide extension. In yet a further alternate exemplary embodiment, a second bump 408 is formed on the tine 106 opposite the first bump 400. The second bump also extends into the longitudinal slot portion 92. A second depression 410 complementary to the second bump is formed on the actuator guide member 406 to accommodate the second bump.

In yet another exemplary embodiment, a ramp 415 may be formed on the transverse edge 102 of transverse portion 100 of the slot 90, as for example shown in FIG. 8, for aiding in the retention of the guide member in an "armed" state. The ramp may be defined by a bump 413 extending from the transverse edge 102. Moreover, in another exemplary embodiment, an edge 411 of the longitudinal portion 92 of the slot 90 may be slightly curved forming a concavity, as for example shown in FIG.8, to avoid squeaking as the actuator guide member moves along the longitudinal slot portion. Squeaking typically occurs when a plastic member slides against another plastic member.

In a further alternate exemplary embodiment, instead of being coupled to the rear wall 52 of the housing, the guide pin 78 is coupled to the front wall 51 of the housing and is capable of pivoting relative to the front wall.

With any of the embodiments of the present invention, the self-closing mechanism housing also provides lateral support to the slide inner member as it slides over the housing. Furthermore, any of the aforementioned housing may incorporate any of the legs described herein for mounting on the slide outer member.

Figure 9:
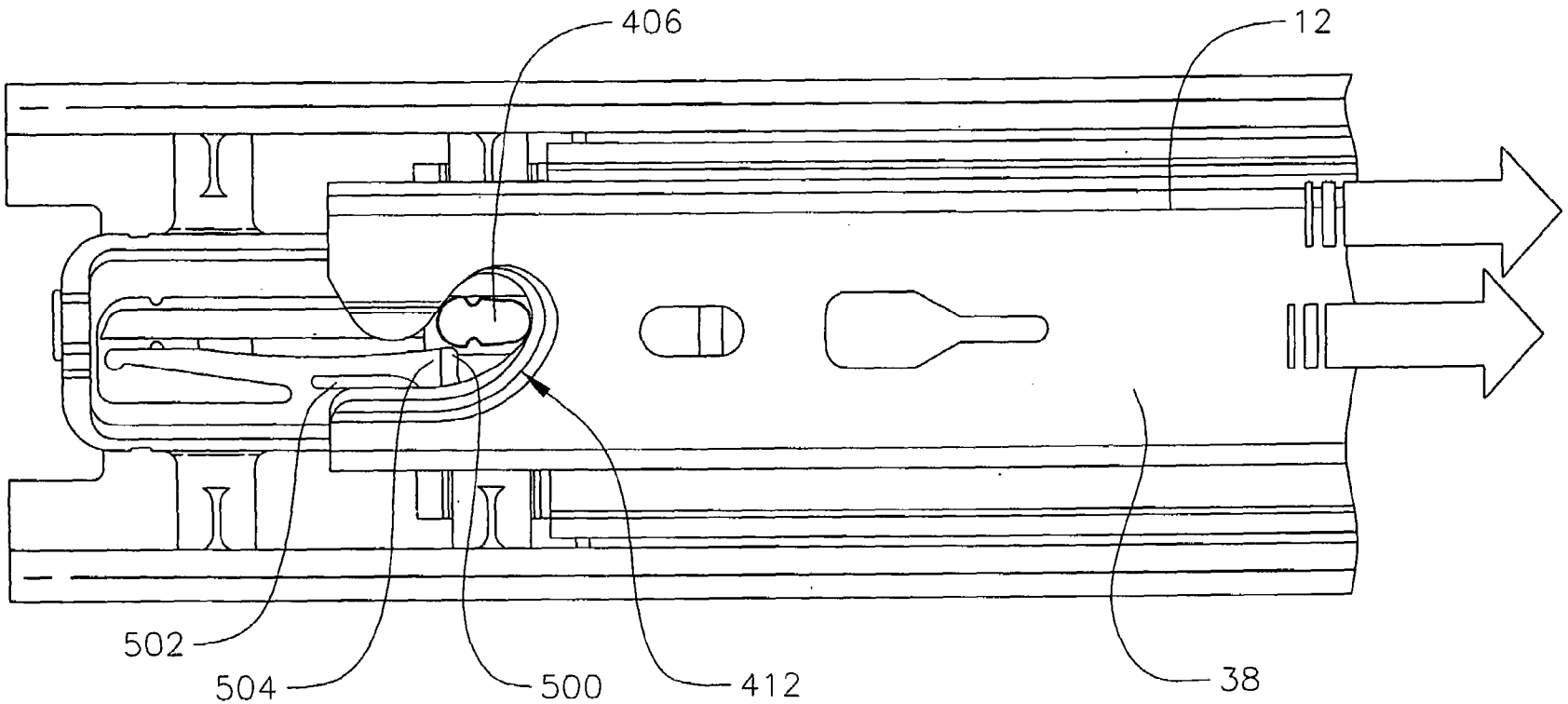
FIG. 9 is a partial copy of another exemplary embodiment three-member self-closing slide incorporating an exemplary embodiment self-moving mechanism of the present invention showing the inner slide member of the slide and the self-moving mechanism actuator in a position prior to the actuator being armed.
Figure 10:
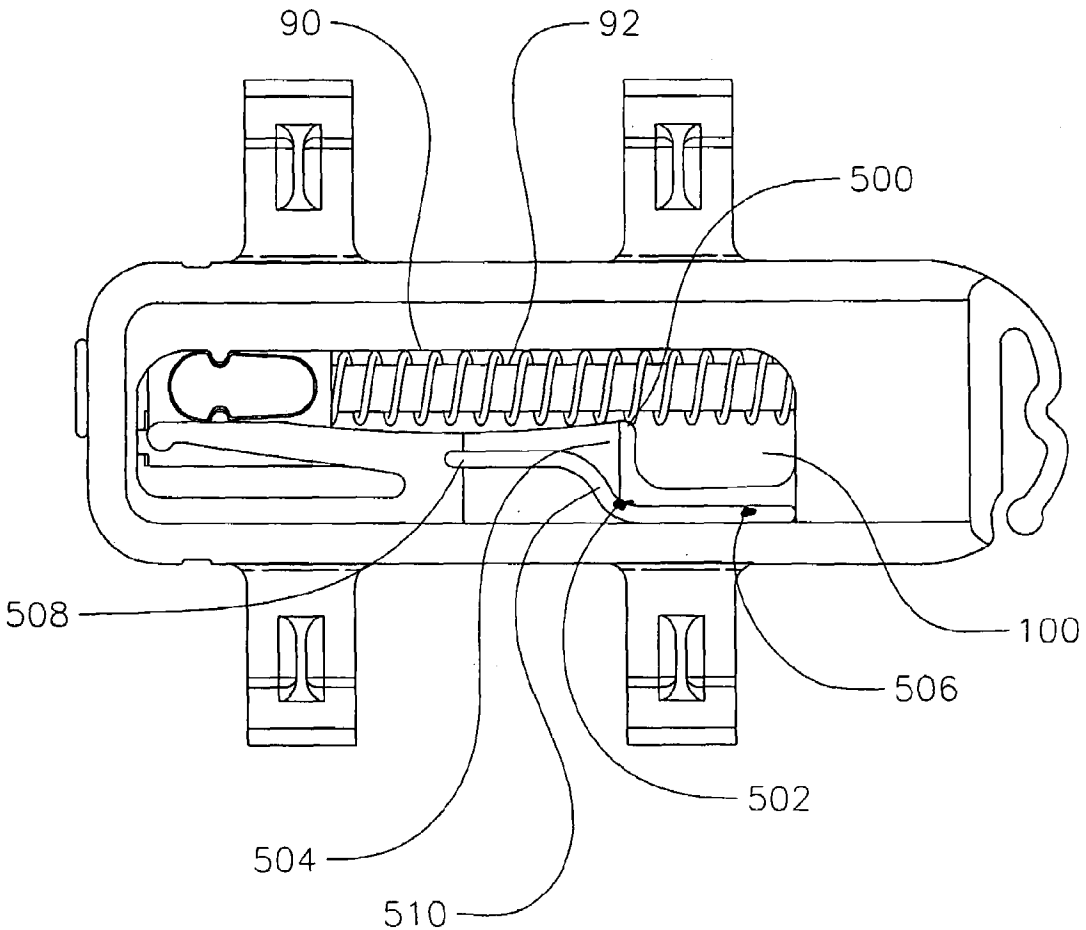
FIG. 10 is a top view of an exemplary embodiment self-moving mechanism of the present invention

With any of the aforementioned exemplary embodiments, a junction (e.g., a corner or tip) 500 is formed at the intersection of the longitudinal portion 92 and the transverse portion 100 of the slot 90 formed through the top wall of the housing, as for example shown in FIGS. 3, 8 and 9. As the guide member 108 or 406 of the actuator is moved by the web of the inner slide member 12 along the longitudinal portion 92 the slot 90 and cross-wise through the transverse portion 100 of the slot 90, the actuator guide member makes contact with and presses against the junction 500 causing the junction to wear down. To reduce the wearing down of the junction, a slot, e.g., a cut-out, 502 may be incorporated in the housing top wall as for example shown by dashed lines in FIGS. 3 and 8 and as also shown in FIGS. 9 and 10. In this regard, as the actuator guide member 108, 406 transitions from the longitudinal portion 92 to the transverse portion 100 of the slot formed on the top wall of the housing and presses against the junction 520, the slot 502 allows a portion 504 of the top wall from the junction to the slot 502 to move collapsing the slot 502 such that the junction moves with the actuator guide member as the actuator guide member presses on it. Consequently, the resistance offered by the junction against the actuator guide member as the actuator guide member presses on the junction is reduced, and thus, the wear on the junction caused by the contact and rubbing with the actuator guide member is also reduced.

In the exemplary embodiment shown in FIG. 10, the slot 502 has two longitudinal sections 506, and 508 offset from each other via an intermediate section 510. In the exemplary embodiment shown in FIG. 10, the two longitudinal sections 506 and 508 tend to run longitudinally along the housing top wall. In this regard, the slot 502 is better able to follow the contour of the slot 90 formed on the top wall of the housing such that the section 508 of the slot 502 is closer to the longitudinal portion 92 of the top wall slot 90, and the section 506 of the slot 502 is closer to the transverse portion 100 of the top wall slot 90. Moreover, in the exemplary embodiment, the intermediate portion 510 of the slot 502 is oblique relative to the longitudinal axis of the longitudinal portion 92 of the top wall slot 90. In this regard, the junction 500 of the upper wall is able to move both laterally and longitudinally when pressed by the actuator guide member.

Figure 11A:
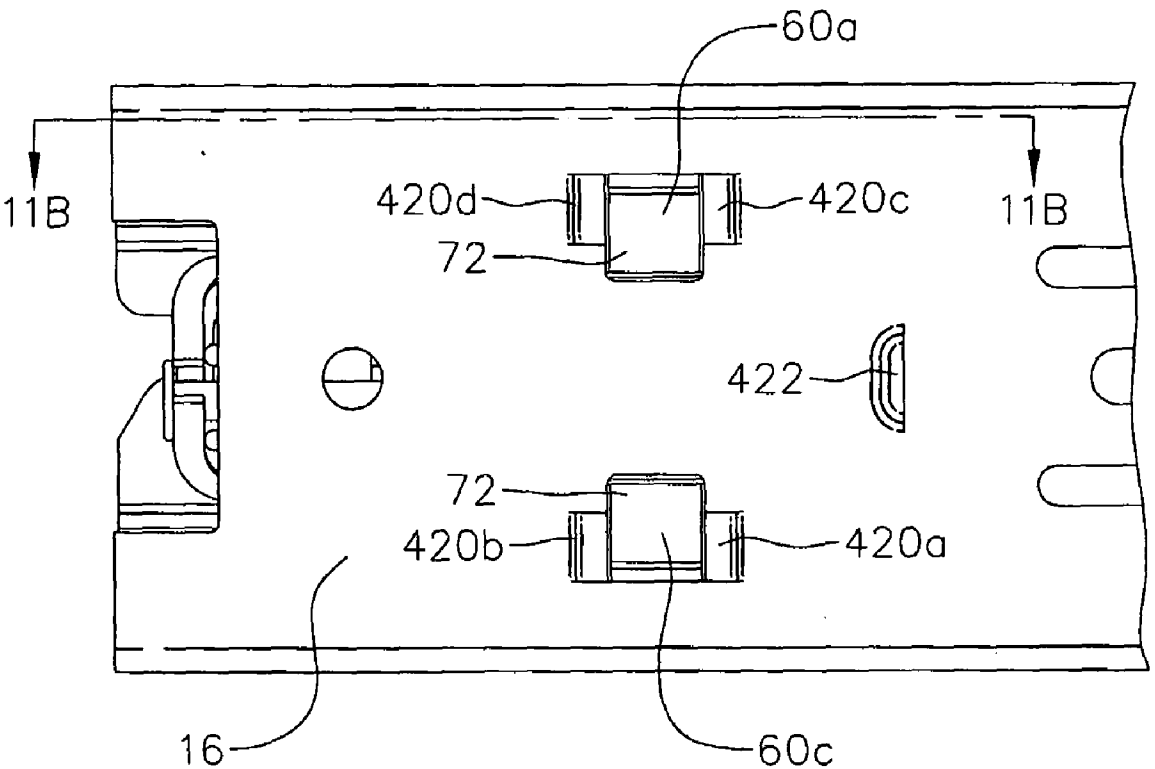
FIG. 11A is a partial bottom view of an exemplary embodiment self-closing slide incorporating an exemplary embodiment self-moving mechanism of the present invention.
Figure 11B:
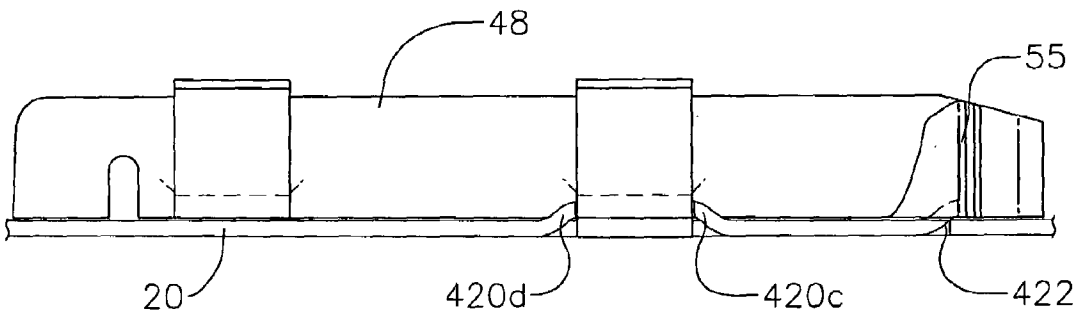
FIG. 11B is a partial side view taken along arrows 11B-11B of the self-closing slide shown in FIG. 11A.

With any of the aforementioned embodiments, the web portion of the slide web surrounding the legs of the housing may be lanced upwards. For example, as shown in FIGS. 11A and 11B, a portion of the slide web 20 immediately behind the housing legs 60*a* and 60*c* are raised i.e., lanced forming lances 420*d* and 420*b*, respectively. These lances provide further support to the housing and prevent the housing from sliding backward along the web 20 as the slide and actuator close. In yet a further alternate exemplary embodiment, the web 20 is lanced at a location for creating a lance 422 immediately behind the housing front wall 55. The lance 422 also provides support for preventing the housing from sliding backwards along the web 20 as the slide is closed. In another exemplary embodiment, the portions of the web in front of the legs are also lanced. For example, as shown in FIGS. 11A and 11B, lances 420*a* and 420*c* are formed in front of the housing legs 60*c* and 60*a*, respectively and opposite lances 420*b* and 420*d* respectively. Consequently a depression is defined between each pair of opposite lances, e.g., 420*a*, 420*b* and 420*c*, 420*d* for accommodating a leg of the housing. These depressions provide a predefined location for the legs to couple to the housing.

Figure 12:
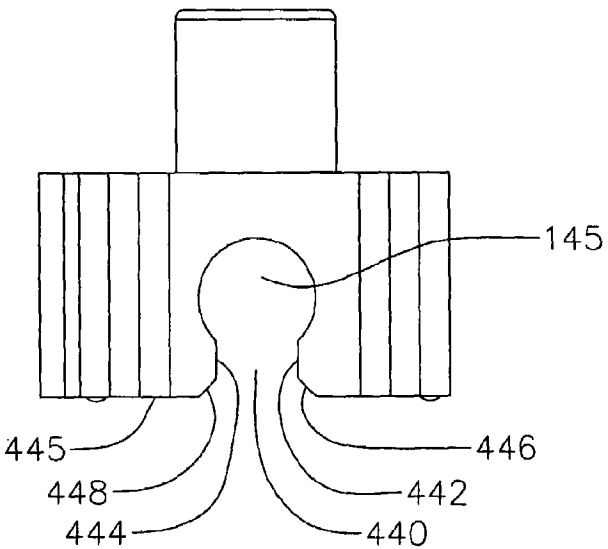
FIG. 12 is an end view of an alternate exemplary embodiment actuator of the present invention.

Moreover in any of the aforementioned exemplary embodiments incorporating a guide pin and an actuator, as for example the embodiments shown in FIGS. 3, 7A, and 8, the actuator opening accommodating the guide pin, as for example the opening 145 formed on the wall 143 of the actuator as shown in FIG. 12, is extended to the free end 445 of the wall 143. In the exemplary embodiment shown in FIG. 12, the opening extends to the free end 445 of the wall via a slot 440 having a width that is smaller than the diameter of the opening. The width of the slot 440 should also be slightly smaller than the diameter of the guide pin. This allows for the actuator to "snap" on to the guide pin as for example guide pin 78. In other words, the guide pin "snaps" through the slot 440 into the opening 145. The slot 440 is defined between two edges 442, 444. These edges taper outward forming tapering edges 446, 448, respectively, at their intersection with the free end 445 of the wall increasing the width of the slot at the free end 445 of the wall. The tapering edges 446, 448 serve to guide the guide pin to the slot when the actuator is being "snapped" over the guide pin.

Figure 13:
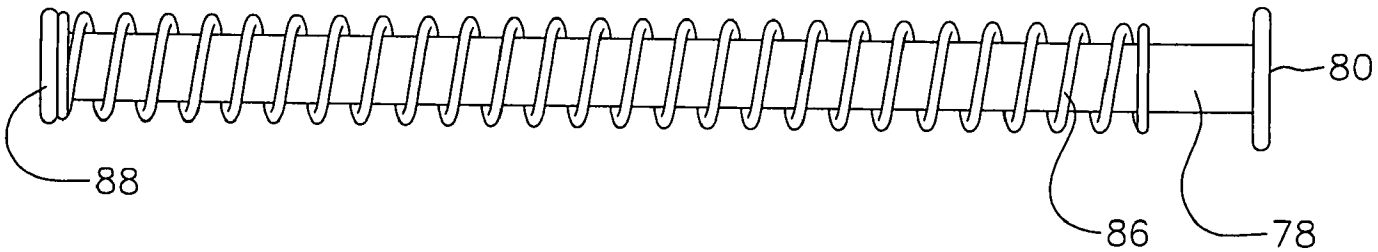
FIG. 13 is a top view of a spring surrounding a capped guide pin.
Figure 14:
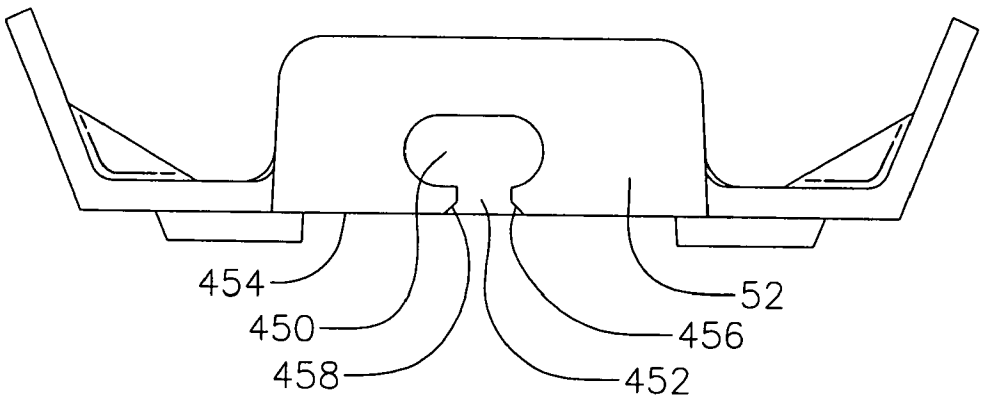
FIG. 14 is an end view of an exemplary housing for a self-moving mechanism of the present invention.

Further with any of the aforementioned embodiments incorporating a guide pin, as for example the embodiments shown in FIGS. 3, 7A, and 8, the spring as for example spring 86 is fitted over the guide pin, as for example guide pin 78, and the guide pin is capped at both ends, e.g., a cap is formed at each end, as for example caps 80 and 88 shown in FIG. 13. One end of the guide pin may be capped prior to fitting the spring. If an actuator, as for example the actuator shown in FIG. 12 is used, the actuator may then be "snapped" on the guide pin. Alternatively, the pin may be fitted within the actuator prior to capping. The guide pin with spring and actuator may then be "snapped" onto a wall of the housing, as for example the housing rear wall. To allow for snapping of the pin onto the housing rear wall, the rear wall of the housing, as for example wall 52 shown in FIG. 14, is formed with an opening 450 which extends to the lower end 454 of the rear wall 52 via a slot 452 having a width that is smaller than the diameter of the opening 450. In the exemplary embodiment shown in FIG. 14, the opening 450 has an elliptical shape whose minor diameter is greater than the guide pin diameter. The elliptical shape allows for the pin slide across the opening as well as pivot about the opening. The slot 452 width is slightly smaller than the diameter of the guide pin so as to allow the pin to "snap" through the slot and into the opening 450. Portions of the edges of the slot 452 extending to the lower end 454 taper outwards forming tapering edges 456, 458, increasing the width of the slot 452 to a dimension greater than the diameter of the guide pin. This increase in slot width provides a guide for guiding the guide pin to the slot 452 for being "snapped" in place.

In addition, when the mechanisms of the present invention are used with a three member slide, a longer intermediate slide member may be used by cutting out a portion of the web 28, forming a cut-out 460 to accommodate a front portion 462 of the self-closing mechanism as for example shown in FIG. 8. This would also allow use of longer ball bearing retainers and allow the slide to hold more weight.

Any of the self-moving mechanisms of the present invention may be mounted on a slide member such as the outer slide member 16 having a cut-out 464 as for example shown in FIG. 8 to allow the slide member to couple to a rear bracket (not shown).

With any of the aforementioned embodiments, the spring may be compressed when armed. In other words, with any of the aforementioned embodiments, a compression spring may be used. In this regard, failure of the spring when armed would likely not cause the spring to eject from the mechanism as would occur if the spring were stretched during when armed as occurs with self-closing mechanisms using springs. In other exemplary embodiments, however, a tension spring may be used. Another advantage of the self-moving mechanism of the present invention is that they modular and can be easily incorporated into existing slides by slightly modifying the slide as for example, by forming a slot on the slide inner member web and by shortening the slide intermediate member if an intermediate member is used. Moreover, the mechanisms of the present invention do not require external tabs or other members to be connected to the slide to interface with the mechanism, which would be subject to early fatigue failures.

The preceding merely illustrates the principles of the invention. It will thus be appreciated that those skilled in the art will be able to devise various arrangements which, although not explicitly described or shown herein, embody the principles of the invention and are included within the scope and spirit. Furthermore, all examples and conditional language recited herein are principally intended expressly to be only for pedagogical purposes and to aid in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and the functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of the present invention is embodied by the appended claims.

The invention claimed is:

1. A self-moving slide comprising:

a first slide member;

a second slide member slidably coupled to the first slide member;

a self-moving mechanism coupled to the second slide member comprising a housing, a first slot formed on a wall of the housing, the first slot having a first longitudinal portion and a second portion extending transversely to the first portion, wherein a junction is defined on the housing wall between the first and second slot portions;

a second slot formed on the wall of the housing; and an actuator moveable along the first slot between the first longitudinal portion and the second portion, wherein as the actuator moves between the first longitudinal portion and the second portion it exerts a force against the junction, and wherein the second slot allows a portion of said wall including the junction to move in response to said force.

2. The self-moving slide as recited claim 1 further comprising a spring coupled to the actuator, wherein the actuator moves in response to a force generated by said spring.

3. The self-moving slide as recited in claim 2 wherein the spring is compressed when the actuator is guided along the second portion of the first slot.

4. The self-moving slide as recited in claim 3 wherein when the actuator is within the second portion of the first slot formed on the housing, the spring is compressed.

5. The self-moving mechanism as recited in claim 1 wherein the housing comprises a first wall spaced apart from the second slide member defining a space there between, and at least a side wall extending from the first wall toward the second slide member, wherein the space is bounded by the first wall, the second slide member and the at least a side wall, and wherein the spring is located within space, and wherein the first slide member slides over the space and the spring.

6. The self-moving slide of claim 1 further comprising a slot formed on the first slide member and extending to an end of the first slide member, wherein at least a portion of said actuator is received within the slot, and wherein the end of the first slide member is transverse to a longitudinal axis of the first slide member.

7. The self-moving slide as recited in claim 6 wherein the first slide member comprises a web portion between two leg portions and wherein the slot is formed on the web portion.

8. The self-moving slide as recited in claim 6 wherein the slot formed on the first slide member comprises a first portion extending to an end of the first slide member facing the self-closing mechanism and a second portion extending from the first portion and generally at an angle relative to the first portion.

9. The self-moving slide as recited in claim 8 wherein an edge of the first portion of the slot formed on the first slide member and an edge of the second portion of the slot formed on the first slide member define a tip.

10. The self-moving slide as recited in claim 9 wherein the tip is rounded.

11. The self-moving slide as recited in claim 9 wherein first slide member comprises a web portion along a first plane between two leg portions and wherein the tip extends along a second plane offset from the first plane.

12. The self-moving slide as recited in claim 11 wherein the tip is joggled.

13. The self-moving slide as recited in claim 1 further comprising a third slide member between the first and second slide members.

14. The self-moving slide as recited in claim 1 further comprising a pin coupled to the housing and penetrating the spring and actuator.

15. The self-moving slide as recited in claim 14 wherein the actuator compnses:

an actuator opening for accommodating the pin; and an actuator slot extending from the actuator opening to a free end of the actuator, wherein the pin has a diameter, wherein the actuator slot has a width smaller than the diameter, and wherein the pin is pushed into the actuator opening through the actuator slot.

16. The self-moving slide as recited in claim 14 wherein the pin is coupled to a housing wall, said housing wall comprising:

a wall opening for accommodating the pin; and a wall slot extending from the wall opening to a free end of the housing wall, wherein the pin has a diameter, wherein the wall slot has a width smaller than the diameter of the pin, and wherein the pin is pushed into the wall opening through the wall slot.

17. The self-moving slide as recited in claim 14 wherein the pin is coupled to the housing at a location offset from a central longitudinal axis of the first slot.

18. The self-moving slide as recited in claim 1 wherein the actuator comprises a protrusion guided within the first slot.

19. The self-moving slide as recited in claim 1 further comprising a third slot formed on the housing proximate an end of the housing, offset from the first slot and in communication with the first slot defining a tine between an edge of the first slot and an edge of the third slot.

20. The self-moving slide as recited in claim 19 further comprising a detent formed on an edge of the first slot opposite the edge of the first slot defining the tine.

21. The self-moving slide as recited in claim 1 wherein the actuator comprises a protrusion moveable within the first slot wherein the protrusion is cylindrical.

22. The self-moving slide as recited in claim 1 wherein the actuator comprises a protrusion moveable within the first slot, wherein the protrusion is elongate.

23. The self-moving slide of claim 22 wherein the protrusion comprises a first semi-circular end opposite a second semi-circular end, wherein the diameter of the first semi-circular end is larger than the diameter of the second semi-circular end.

24. The self-moving slide as recited in claim 1 wherein the second slot comprises:

a first longitudinal portion;

a second longitudinal portion; and an intermediate portion between the first and second longitudinal portions, wherein the intermediate portion is transverse to both the first and second portions.

25. The self-moving slide as recited in claim 1 further comprising a spring coupled to the actuator wherein the spring is located between the housing wall and the second slide member, wherein the first slide member slides over the housing wall and the spring.

26. The self-moving slide as recited in claim 1 wherein the second slot extends in a direction along the length of the first slot from a location proximate the second portion of the first slot to a location proximate the first portion of the first slot.

27. A self-moving slide comprising:

a first slide member;

a second slide member slidably coupled to the first slide member;

a self-moving mechanism coupled to the second slide member comprising a housing, a first slot formed on a wall of the housing;

a second slot formed on the wall of the housing spaced apart from the first slot defining a wall portion therebetween; and an actuator moveable along the first slot, wherein as the actuator moves along the first slot it exerts a force on the wall portion, and wherein the second slot allows the wall portion to move in response to said force.

28. The self-moving slide as recited in claim 27 wherein the second slot comprises two longitudinal portions interconnected by a non-longitudinal portion.

29. The self-moving slide as recited in claim 28 wherein the slot longitudinal and non-longitudinal portions allow the wall portion to move longitudinal and transversely relative to the movement of the actuator.

30. The self-moving slide as recited in claim 27 wherein the second slot is non-linear.

31. The self-moving slide as recited in claim 27, wherein when the actuator exerts a force on the wall portion, the second slot collapses allowing the wall portion to move in response to the force.

* * * * *

UNITED STATES PATENT AND TRADEMARK OFFICE

CERTIFICATE OF CORRECTION

PATENT NO. : 7,104,691 B2
APPLICATION NO. : 10/889616
DATED : September 12, 2006
INVENTOR(S) : Chi It is certified that error appears in the above-identified patent and that said Letters Patent is hereby corrected as shown below:

In the Claims

| | |
|---|---|
| Column 13, line 21, Claim 2 | Before "claim 1",<br>Insert --in-- |
| Column 13, line 36, Claim 5 | After "located within",<br>Insert --the-- |
| Column 14, line 8, Claim 15 | Delete "compnses",<br>Insert --comprises-- |
| Column 14, lines 13-14, Claim 15 | Delete ", and wherein the pin is pushed into the actuator opening through the actuator slot" |
| Column 14, line 20, Claim 16 | Delete "pin has a diameter,",<br>Insert --pin has a diameter, and-- |
| Column 14, lines 22-23, Claim 16 | Delete ", and wherein the pin is pushed into the wall opening through the wall slot" |
| Column 14, line 28, Claim 18 | Delete "within",<br>Insert --along-- |
| Column 14, line 31, Claim 19 | Delete "," |
| Column 14, line 39, Claim 21 | Delete "slot wherein",<br>Insert --slot, wherein-- |
| Column 15, line 2, Claim 27 | Delete "comprising a housing",<br>Insert --comprising,<br>a housing-- |
| Column 15, line 3, Claim 27 | Delete "housing;",<br>Insert --housing,-- |

UNITED STATES PATENT AND TRADEMARK OFFICE

CERTIFICATE OF CORRECTION

PATENT NO. : 7,104,691 B2
APPLICATION NO. : 10/889616
DATED : September 12, 2006
INVENTOR(S) : Chi It is certified that error appears in the above-identified patent and that said Letters Patent is hereby corrected as shown below:

| | |
|---|---|
| Column 15, line 6, Claim 27 | Delete "therebetween;",<br>Insert --therebetween,-- |
| Column 16, line 7, Claim 31 | Delete "claim 27,",<br>Insert --claim 27-- |

Signed and Sealed this

Fifth Day of February, 2008

JON W. DUDAS
*Director of the United States Patent and Trademark Office*